US005574485A

United States Patent [19]

Anderson et al.

[11] Patent Number: 5,574,485

[45] Date of Patent: Nov. 12, 1996

[54] ULTRASONIC LIQUID WIPER FOR INK JET PRINTHEAD MAINTENANCE

[75] Inventors: David G. Anderson; Alfred J. Claflin, both of Ontario; John Chinnici, Rochester, all of N.Y.

[73] Assignee: Xerox Corporation, Stamford, Conn.

[21] Appl. No.: 322,128

[22] Filed: Oct. 13, 1994

[51] Int. Cl.[6] ..... B41J 2/165

[52] U.S. Cl. ..... 347/27; 134/1; 347/28

[58] Field of Search ..... 347/22, 27, 28, 347/30, 32, 42; 134/1, 122 R, 151, 153; 366/120, 121, 127

[56] References Cited

U.S. PATENT DOCUMENTS

| | | | |
|---|---|---|---|
| 4,395,719 | 7/1983 | Majewski et al. | 347/68 |
| 4,609,925 | 9/1986 | Nozu et al. | 347/27 |
| 4,849,769 | 7/1989 | Dressler | 347/27 |
| 4,947,191 | 8/1990 | Nozawa et al. | 347/30 |
| 4,951,066 | 8/1990 | Terasawa et al. | 347/33 |
| 5,117,244 | 5/1992 | Yu | 347/29 |
| 5,198,054 | 3/1993 | Drake et al. | 156/64 |
| 5,250,962 | 10/1993 | Fisher et al. | 347/32 |
| 5,304,814 | 4/1994 | Markham | 250/573 |
| 5,339,842 | 8/1994 | Bok | 134/1 |

FOREIGN PATENT DOCUMENTS

| | | | |
|---|---|---|---|
| 62-113555 | 5/1987 | Japan | 347/27 |
| 5-42678 | 2/1993 | Japan | 347/22 |

*Primary Examiner*—John E. Borlow, Jr.

[57] ABSTRACT

An ultrasonic liquid wiper for an ink jet printer maintenance station has a cleaning nozzle confrontingly aligned but spaced from printhead nozzles suspected of having viscous plugs of partially dried ink. A cleaning solution is held within the cleaning nozzle by surface tension to form a meniscus and is caused to bulge toward into contact with the printhead nozzle face and form a bridge of cleaning solution therewith. In addition to dissolving ink, the cleaning solution is ultrasonically excited by a piezoelectric material immediately upstream of the cleaning nozzle to provide a high frequency energized liquid wiper to facilitate viscous plug removal without having physical contact with the printhead nozzle face, thereby preventing wear of any hydrophobic coating on the nozzle face. A vacuum nozzle is positioned on each side of the cleaning nozzle to remove the cleaning solution deposited on the nozzle face, together with any ink dissolved therein. The cleaning nozzle optionally dwells for predetermined time periods to more effectively loosen and/or dissolve the viscous plugs of ink. The cleaning nozzles may have different concave shapes to aid in the ultrasonic cleaning action of the cleaning solution.

10 Claims, 5 Drawing Sheets

ULTRASONIC LIQUID WIPER FOR INK JET PRINTHEAD MAINTENANCE

BACKGROUND OF THE INVENTION

This invention relates to ink jet printer maintenance systems and more particularly to an ultrasonically excited liquid wiper in a maintenance station for either a partial width array printhead or a full width array printhead, wherein printhead nozzles which fail to eject a droplet or ejects droplets exhibiting misdirectionality are serviced by a liquid wiper at the maintenance station, which is scanned across the printhead face containing the nozzles, while the cleaning liquid between the liquid wiper and printhead face is excited by a piezoelectric device to dislodge and remove any viscous plug of dried ink in the printhead nozzles.

A continuing problem with thermal ink jet printers is the drying of ink at the printhead nozzles, thus causing clogging or partially blocking the nozzles. The result of clogged nozzles is that droplets fail to be ejected or that droplets fail to follow the desired droplet trajectory to the recording medium. To overcome this, a maintenance station is commonly used whereby the printhead is capped or sealed in a high humidity environment to prevent or to greatly retard drying. Maintenance stations include the capability of exerting a vacuum to suck ink from the nozzles to clear the nozzles of dried ink or viscous plugs and to remove any air bubbles that may have accumulated or formed in the printhead. This sucking of ink by the maintenance station is generally referred to as priming. Periodic ejection of ink droplets from the nozzles while the printhead is at the maintenance station also clears the nozzles of dried ink and viscous plugs of ink.

Full width array printheads having 300 to 600 nozzles per inch or more present unique problems for maintenance because of the large numbers of nozzles. For example, a 12 inch wide printhead having 600 nozzles per inch would employ 7200 nozzles, each of which is susceptible of drying out or having ink dry on the printhead nozzle face adjacent one or more nozzles. It is not economically practical to re-prime all of the nozzles each time a few may become clogged or eject misdirected droplets, for too much ink is wasted. Many approaches have been undertaken by the prior art to maintain the operability of all of the nozzles in a full width array printhead, but none have utilized a translating, high frequency energized liquid wiper having the nozzle size similar to the printhead nozzle size to ultrasonically clean the nozzles as the liquid wiper is scanned across the printhead nozzle face.

U.S. Pat. No. 5,250,962 to Fisher et al. discloses a movable priming station capable of priming a portion of an extended array of nozzles at one time in an ink jet printhead by applying a vacuum to at least one nozzle located in the array. The movable priming station includes a support which is moved along the length of the nozzle array and a vacuum tube is attached to the support. One end of the tube functions as a vacuum port which confronts but is spaced from the nozzles, when the support is moved laterally along the nozzle array.

U.S. Pat. No. 5,117,244 to Yu discloses a device to cap a full width array, thermal ink jet printhead without the need of moving the printhead or the paper transport. The capping device has a resilient gasket which contains magnetic material and is attached to the printhead by a relatively thin flexible boot or sleeve. The paper transport is a belt adjacently spaced parallel to the face of the printhead containing the nozzle array. The transport belt is flat and has a steel bar disposed in sliding contact beneath the belt portion confronting the printhead. During operation of the printer, an electromagnet disposed on the printhead is energized, allowing the steel bar to attract the magnetic gasket and seal the gasket to the transport belt.

U.S. Pat. No. 5,304,814 to Markham discloses a sensor circuit and method for detecting the presence of an ink droplet ejected from an ink jet printhead. An integrator integrates the output of the sensor and a high gain amplifier amplifies the integrated signal to provide a sensor circuit output signal. When the droplet at least partially interrupts the light path, the integrated output signal indicates the presence or passage of the droplet. The circuit is preferably used to control a heating element of a thermal ink jet printhead by adjusting the power to the heating elements to assure its operation with a power adequate to eject a droplet.

Copending U.S. Ser. No. 08/047,931, filed Apr. 19, 1993, entitled "Wet-Wipe Maintenance Device For A Full-Width Ink Jet Printer", discloses a shuttle which travels on a track through a fixed path parallel the printhead surface containing an array of nozzles. Mounted on the shuttle are an applicator for applying a liquid to the nozzles and a vacuum device for applying a suction to the nozzles.

SUMMARY OF THE INVENTION

It is the object of this invention to use a high frequency energized wiper apparatus to facilitate viscous ink plug removal on a nozzle-by-nozzle basis in a full width array printhead.

It is another object of the present invention to provide a cleaning solution in a scanning wiper apparatus having a nozzle, so that the cleaning solution is held in the wiper nozzle by a selectively expandable meniscus which can extend into contact with and bridge to a printhead nozzle wherein the bridging cleaning solution is ultrasonically energized by a piezoelectric device.

In the present invention, an ultrasonic liquid wiper apparatus is translated along the length of a partial or full width array printhead to apply a high frequency energized meniscus bridge along the entire length of the printhead nozzle face or to only one nozzle at a time. This energized meniscus bridge scrubs dried ink from the nozzle face and couples with the viscous plugs of dried ink in the nozzles to loosen and remove them as the liquid wiper apparatus is scanned across the printhead nozzle face. Optionally, the scanning liquid apparatus can dwell for predetermined time periods aligned with a clogged printhead nozzle for hard to remove viscous plugs. In one embodiment, a translating or scanning carriage contains not only the ultrasonic liquid wiper and a vacuum nozzle to remove the cleaning solution deposited by the liquid wiper, but also a droplet sensor to monitor nozzle performance of each nozzle. Problem nozzles are identified and electronically stored in the printer controller. The stored location of the problem nozzles permits a recovery procedure by the ultrasonic liquid wiper apparatus, mounted on the same translatable carriage as the droplet sensor, under the control of the printer controller to address each specific problem nozzle either during a continuous carriage scan across the printhead nozzle face or by only individually addressing the problem nozzles with the liquid wiper for a predetermined dwelled time. Various maintenance algorithms have been programmed in the printer controller. The algorithms include such actions as dwell time or increased dwell time for the problem nozzle, increased vacuum or priming suction, or repeated wet wipe with the ultrasonic liquid wiper prior to a vacuum cleaning operation to remove the liquid cleaning solution and dissolved or entrained ink or other contaminants therein. The corrected problem nozzles are checked again for proper performance after the recovery operation by the ultrasonic liquid wiper apparatus. If all nozzles are functioning properly, the printer controller enables printing by the printer. If one or more nozzles are still malfunctioning, the controller resends the ultrasonic liquid wiper apparatus to the remaining problem nozzles for a programmed number of times. If all nozzles are not returned to satisfactory operation, an error signal is communicated to the printer control panel to display and inform the printer user that the printer is disabled from a printing mode unless manually overridden by the printer user.

The foregoing features and other objects will become apparent from a reading of the following description in conjunction with the drawings, wherein like index numerals indicate like parts.

DESCRIPTION OF THE PREFERRED EMBODIMENT

Figure 1:
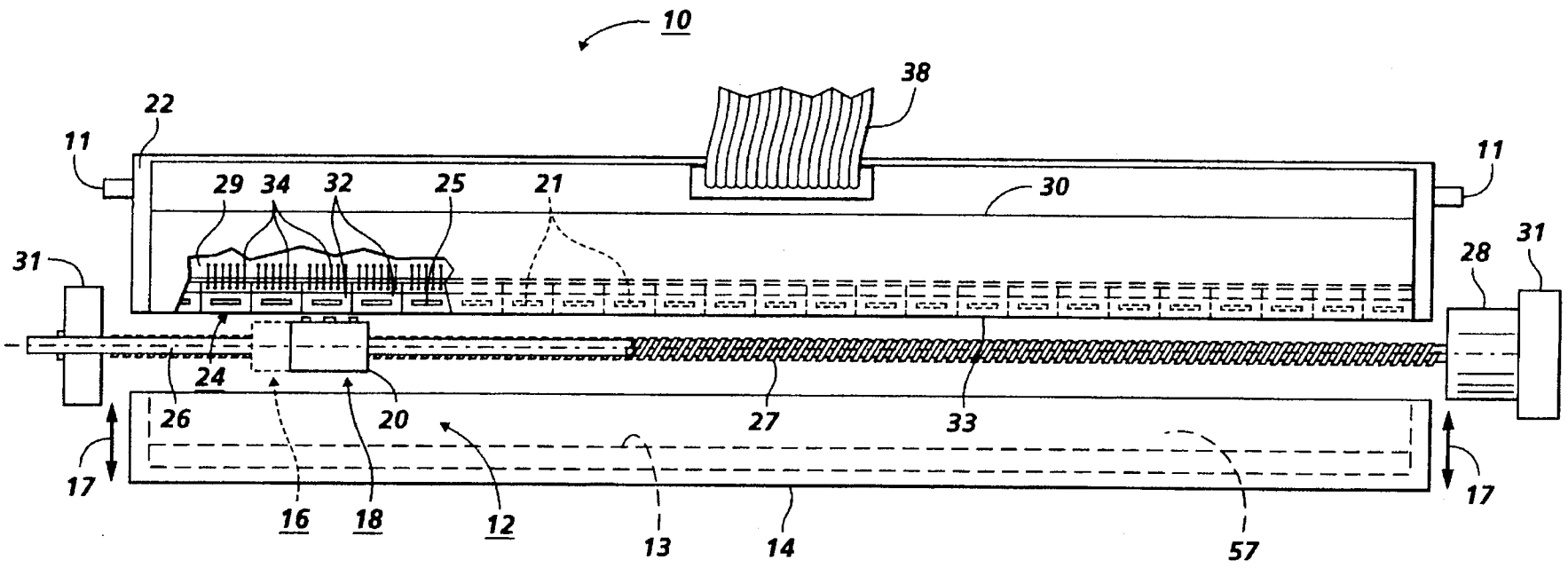
FIG. 1 is a partially shown schematic plan view of a full width array printhead for an ink jet printer, the printhead being positioned at a maintenance station having a nozzle recovery device, which includes an ultrasonic liquid wiper, mounted on a carriage that is translatable across and parallel to the nozzle face of the printhead.
Figure 3:
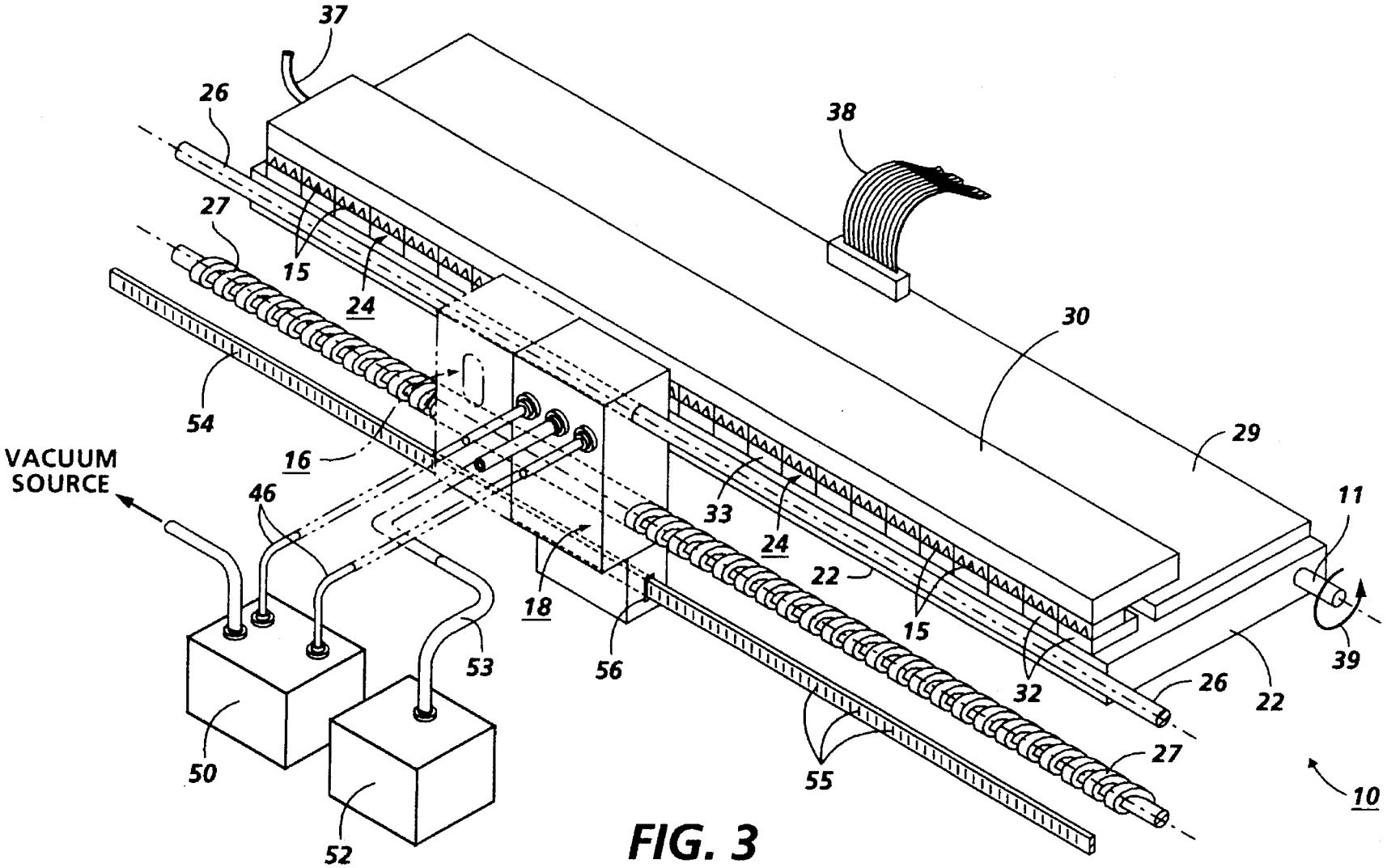
FIG. 3 is an isometric view of the full width array printhead showing the nozzle array in the nozzle face thereof, with a nozzle recovery device shown confronting the nozzle array.

In one well known type of drop-on-demand ink jet printer, a full width array printhead 10, such as that shown in FIGS. 1 and 3, is held in a stationary position, when the printer is in the printing mode, and a recording medium (not shown), such as cut sheets of paper, is moved past the printhead at a constant velocity to receive ink droplets ejected from the printhead. The printhead has a linear array of nozzles 15 that extend completely across the width of the recording medium. Thus, if one nozzle out of the entire array malfunctions, a streak of missing image is readily apparent in a direction parallel to the direction of movement of the printed sheet of recording medium. When the printer is not printing, the printhead is repositioned to a maintenance station 12, as shown in FIG. 1. Here the printhead nozzles 15 may be sealed by a movable cap 14 to prevent drying of the ink in the nozzles or, as shown in FIG. 1, the cap may be retained in a spaced position and a nozzle recovery device 18 used to correct the problem nozzles by cleaning and priming.

Figure 2:
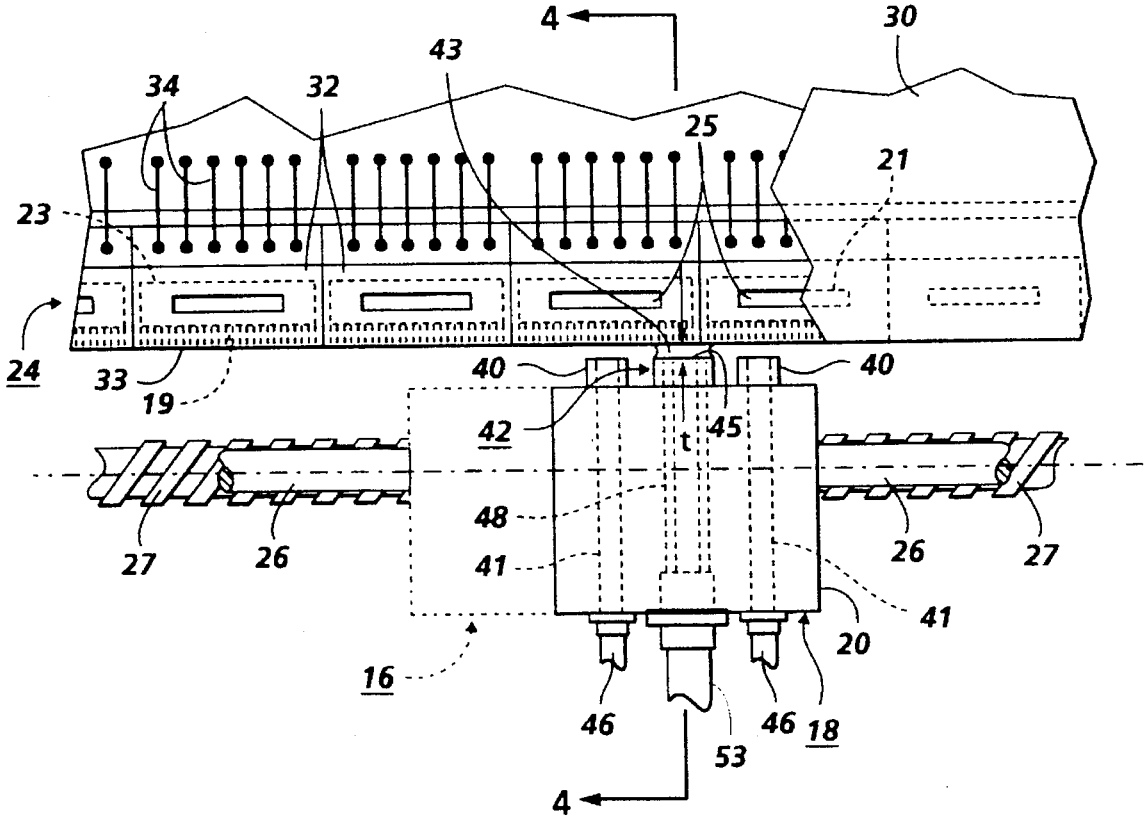
FIG. 2 is an enlarged schematic plan view of the nozzle recovery device shown in FIG. 1.

FIG. 1 is a partially shown, schematic plan view of the full width array printhead 10 located at a maintenance station 12, comprising a nozzle recovery device 18, integrally mounted on a translatable carriage 20, and a movable cap 14. The cap 14 is shown spaced from the printhead 10, but may be actuated by any suitable means (not shown) such as, for example, a solenoid, to move the cap into and out of sealing contact with the nozzle face 33 of the printhead, as indicated by arrow 17, when the printhead is not in the printing mode. As is well known, the cap provides an air tight chamber 57 (shown in dashed line), when sealed around the array of nozzles 15 in the printhead face, and the sealed chamber is generally humidified to provide a moist atmosphere which prevents the ink in the nozzles from drying out. The humidity in the cap may be provided in several known ways, such as, by absorbent pad 13, shown in dashed line, which may be filled with ink or other liquid. One known way to fill the absorbent pad is by ejection of ink droplets into it from the printhead nozzles, and another is by way of a separate liquid supply (not shown). In order to cap the printhead nozzles, when the printhead is not printing, the printhead must be moved away from a position confronting the recording medium transport means (not shown), usually a transport belt. In FIGS. 1 and 2, the printhead 10 is shown rotated away from the printing zone (not shown), where it would face the transport means, to a location adjacently confronting the translatable carriage 20 in the maintenance station. The printhead relocation is, for example, by rotation about trunnions 11 which extend from the opposite ends of the mounting substrate 22, as indicated by arrows 39 in FIG. 3. The carriage 20 is translated back and forth along a guide rail 26 and rotatably driven lead screw or threaded shaft 27, which are parallel to each other. The guide rail is fixedly mounted in fixed frame members 31 of the printer (not shown), and the threaded shaft is rotatably mounted in the frame members 31 and driven by electric motor 28. The guide rail and shaft are separated from each other by a distance sufficient to permit the cap to move between them, when carriage 20 is moved to one side of the printhead.

Figure 4:
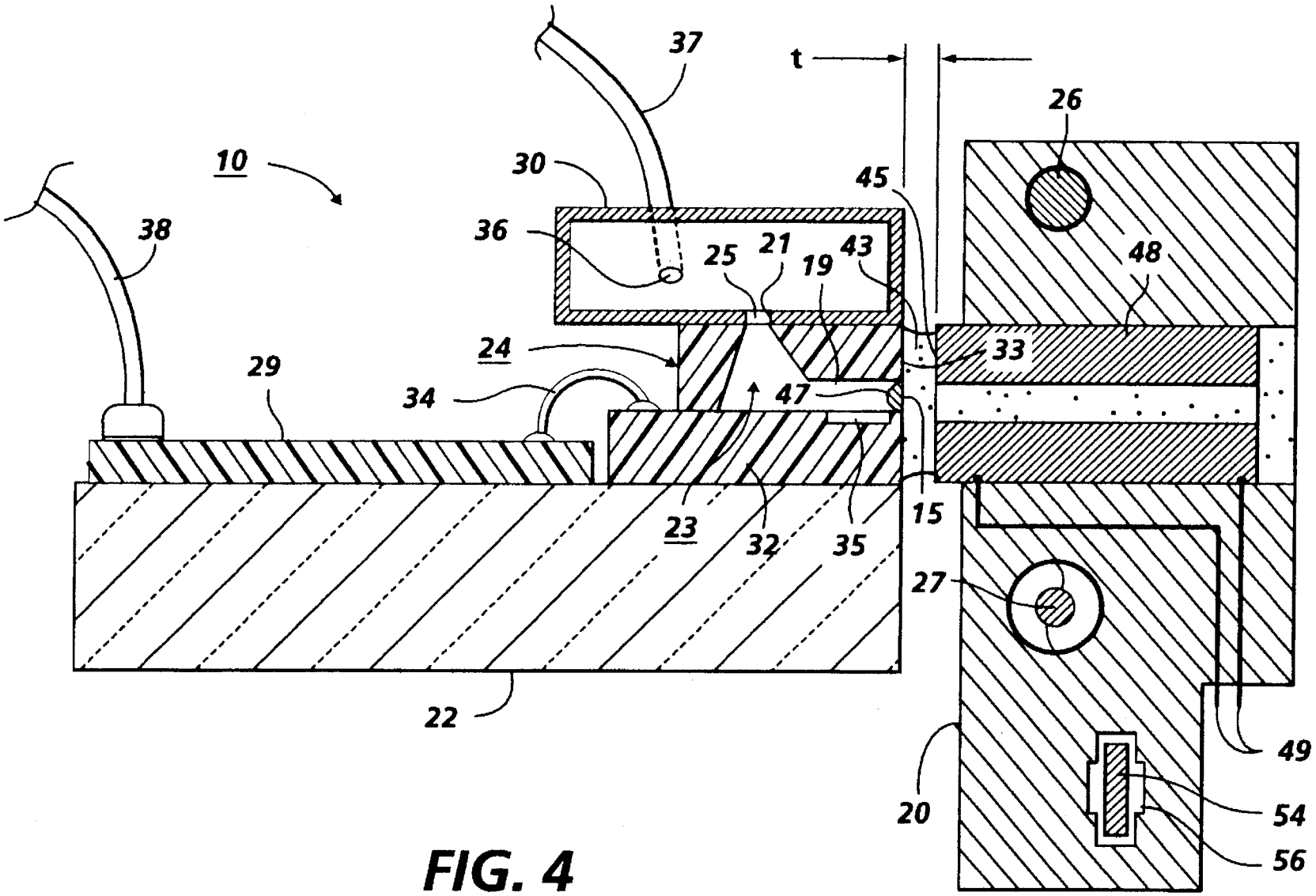
FIG. 4 is a schematic cross-sectional side view of the nozzle recovery device showing the ultrasonic liquid wiper in cross-section as it confronts a one of the nozzles of the full width array printhead as viewed along section line 4—4 of FIG. 2.

The full width array printhead 10 is assembled from printhead subunits 32 into a linear array of subunits on mounting substrate 22 as disclosed in U.S. Pat. No. 5,198,054 to Drake et al., incorporated herein by reference. The mounting substrate is preferably graphite, but may be any suitable metal such as steel or aluminum. The mounting substrate not only provides the structural integrity for mounting of the printhead 10 in the printer, but also is a means of heat management, since it readily conducts and dissipates heat. Additional cooling may be provided by the circulation of a coolant (not shown) through the mounting substrate 22. A printed circuit board 29 is bonded to the mounting substrate adjacent the subunit array and connected thereto by wire bonds 34. To print the required information, a printer controller (not shown) controls electrical pulses to the heating elements 35 (shown in FIG. 4), one heating element being located in each channel 19 of each subunit 32, by individually addressing each heating element via ribbon cable 38, electrodes on the circuit board 29, and wire bonds 34 to the monolithically integrated driver circuitry and logic (not shown) on each subunit 32. Referring to FIGS. 1 and 4, an ink supply manifold 30 is mounted on the side of the array 24 of printhead subunits 32, opposite the subunit sides bonded to the mounting substrate 22, and is in sealed communication with the ink inlets 25 of the subunit reservoirs 23 through aligned openings 21 in the manifold 30 to supply ink to the subunit array 24. The main ink supply (not shown) is located in the printer separately from the manifold and is connected to the manifold by hose 37 sealingly attached to the manifold inlet 36. The printhead subunits each have a linear array of parallel channels 19 in communication with a reservoir 23. The individual nozzle faces of each subunit 32 are coplanar with each other to form a single nozzle face for the subunit array 24.

Periodically the full width array printhead 10 is relocated from the printing zone (not shown) to a position at the maintenance station 12, so that each nozzle 15 may be interrogated or checked, one at a time, by any suitable means, such as, for example, a droplet sensor 16 (shown in dashed line) for droplet ejection and, if a droplet is sensed, then the droplet trajectory is concurrently sensed for appropriate directionality. In the preferred embodiment, an optical droplet sensor 16 is integrally assembled in a carriage 20, adjacent the nozzle recovery device 18. The carriage 20 with droplet sensor and nozzle recovery device is generally positioned to one side of the printhead, thereby enabling the cap 14 to be moved toward and sealed against the printhead nozzle face 33. The cap is moved between the guide rail and threaded shaft to a position against the nozzle face 33, thereby enclosing the entire array of nozzle 15. The nozzle array is capped, when the printer is in the non-printing or standby mode. Even if the printer is in the printing mode, the printing by the printhead is periodically interrupted and moved to the maintenance station for a short period of time, so that the droplet ejection performance of each nozzle can be checked and any problem nozzle recovered by the nozzle recovery device prior to being returned to the printing zone to continue the printing operation. Any failure to eject a droplet or any directionality problem detected causes the printhead to remain at the maintenance station for a predetermined corrective action by the nozzle recovery device as discussed below.

FIG. 2 shows an enlarged schematic plan view of the carriage 20 with integral droplet sensor 16 and nozzle recovery device 18, comprising an ultrasonic liquid wiper apparatus 42 and two vacuum nozzles 40, one on each side of the ultrasonic liquid wiper apparatus, so that a vacuum nozzle is available immediately behind the ultrasonic liquid wiper apparatus no matter which direction the carriage 20 is traversing. A partially shown portion of the subunit array 24 with the ink supply manifold 30 partially removed for clarity is also shown. The nozzle recovery device 18 has at least one and preferably two vacuum nozzles 40 connected by passageway 41, shown in dashed line, to a vacuum source (not shown) through hose 46. The ultrasonic liquid wiper apparatus 42 comprises a piezoelectric tubular transducer 48 mounted on the carriage 20, one end 45 of which extends from the carriage 20 to form a non-contact gap "t" with the nozzle face 33 having a predetermined distance of about 10 mils or 0.25 min. A meniscus 43 of cleaning solution which selectively contacts the nozzle face 33 when the cleaning solution is slightly pressurized to cause the meniscus 43 to bulge forward and form a meniscus bridge with the nozzle face and the nozzles, as the carriage scans across the nozzle face of the printhead.

Any nozzle 15 which contains a viscous plug 47 of dried ink is first located by the droplet sensor 16, such as that disclosed in U.S. Pat. No. 5,304,814 to Markham and incorporated herein by reference, and then the carriage is stopped with the tubular transducer 48 aligned with each problem nozzle for a 2 to 4 second dwell time. The piezoelectric tubular transducer is continuously energized by the printer controller through leads 49 (FIG. 4) which connect to an AC voltage source (not shown). The vacuum nozzles 40 are also spaced by same distance "t" from the nozzle face to enable vacuum removal of the cleaning solution deposited on the nozzle face by the meniscus bridge as the carriage 20 moves along parallel to the nozzle face. The ultrasonically excited cleaning solution dissolves, loosens, or entrains dried ink and other contaminants, such as dust or paper fibers, thereby permitting ready vacuum removal of the cleaning solution with the dried ink and contaminants therein. By dwelling the tubular transducer end 45 in alignment with the problem nozzles for a predetermined time, the high frequency energized cleaning solution in the meniscus bridge enhances the removal of any viscous plug 47 in the nozzles.

When priming is necessary, a one of the vacuum nozzles 40 is stopped in alignment with the selected nozzle and the vacuum suction is increased by the printer controller (not shown) to suck a predetermined quantity of ink from the problem nozzle. The carriage speed for droplet sensing is about 2 inches/second. The return traverse speed of the carriage to recover problem nozzles and clean the nozzle face 33 with the cleaning solution is about 3 inches/second for nozzles with only directionality problems. The nozzles which fail to eject droplets after a cleaning by the ultrasonic liquid wiper 42 are primed by the vacuum removal of 150 to 300 picoliters of ink. The problem nozzles are identified by the droplet sensor and stored in a memory unit of the printer controller and after a first recovery performance of the recovery device 18, the droplet ejection status of each identified nozzle for which recovery action was conducted is checked again by the droplet sensor 16. Any problem nozzle that is not fully corrected is again cleaned or primed by the recovery device and checked again. If after a predetermined number of recovery attempts, three attempts in the preferred embodiment, the printer controller activates a display panel (not shown) which informs the printer operator that one or more nozzles cannot be cleaned and prevents printing by the printer unless a manual override is activated. The manual override enables the printing of less then optimum quality.

The ink removed by a priming operation through the vacuum nozzle and the cleaning solution removed by the vacuum nozzle are both collected in a collection tank 50 (FIG. 3) located intermediate the carriage and vacuum source (not shown). The collection tank is connected to the vacuum passageway 41 by hose 46. The supply of liquid cleaning solution is provided from supply tank 52 to the ultrasonic liquid wiper apparatus 42 by flexible hose 53. The cleaning solution in the supply tank 52 is selectively pressurized by any suitable means to cause the meniscus 43 to bulge, such as, for example, a cam actuated diaphragm or piston (neither shown), into bridging contact with the printhead nozzle face, so that the high frequency excited cleaning solution can more efficiently remove any dried ink on the nozzle face or viscous plugs of dried ink in the nozzles. A similar recovery device without the ultrasonic cleaning ability is disclosed in copending and commonly assigned U.S. patent application No. 08/047,931 filed Apr. 19, 1993, entitled "Wet-Wipe Ink Jet Printer" by Clafin et al.

The ultrasonic liquid wiper of FIG. 2 may be used in a carriage type ink jet printer (not shown) in which the printhead is mounted on a movable carriage which traverses the recording medium and prints one swath of information at a time, while the recording medium is held stationary. The recording medium is stepped the distance of one swath and then the printhead on the carriage traverses the recording medium again to print another swath of information and so on until the entire sheet of recording medium is printed. A maintenance station is located at one side of the printing zone where the printhead is moved for service such as priming and cleaning. For a more detailed disclosure of such maintenance station refer to U.S. Pat. No. 5,257,044. A maintenance station of this type generally has generally at least one fixed wiper blade which cleans the printhead nozzle face each time the printhead enters or leaves the maintenance station. An ultrasonic liquid wiper of the type disclosed in FIG. 2 could replace the wiper blade or be added adjacent thereto. Thus, in one embodiment of this invention, the ultrasonic liquid wiper with vacuum nozzles on each side thereof is fixed in a maintenance station (not shown), such as that described in U.S. Pat. No. 5,257,044 incorporated herein by reference, in the location occupied by the wiper blades or adjacent thereto. Thus, each time a carriage mounted printhead enters or leaves the maintenance station the nozzle face is cleaned by the ultrasonic liquid wiper. The printhead could be stopped with the nozzles aligned with the ultrasonic liquid for short dwell times for more thorough cleaning.

In FIGS. 3 and 4, a linearly encoded strip 54 of suitable material, such as Mylar®, is fixedly mounted between frame members 31 (FIG. 1) and contains on one surface thereof encoding marks (not shown) optically detectable by a sensor (not shown) to provide the exact location of the carriage 20 and, therefore, the droplet sensor 16 and nozzle recovery device's vacuum nozzle 40 and ultrasonic liquid wiper 42, relative to each nozzle 15 in the printhead 10, when the printhead is positioned in the maintenance station 12. The carriage 20 has an aperture 56 through which the fixed encoded strip 54 slidingly resides. The carriage aperture 56 accommodates the movement of the carriage relative to the encoded strip 54, as the printer controller moves the carriage 20 from one end of the array of nozzles to the other.

Referring to FIG. 4, the ultrasonic liquid wiper apparatus 42 consists of a piezoelectric tubular transducer 48 having one end 45 which extends from the carriage 20. Transducer end 45 is spaced from the printhead nozzle face 33 by a predetermined distance established to enable a bulging meniscus 43 of cleaning solution, which is maintained within the tubular transducer from a supply tank 52 (FIG. 3), to contact the nozzle face and form a meniscus bridge therewith. An AC voltage applied to the tubular transducer by the printer controller (not shown) via leads 49, causes a high frequency oscillation of the meniscus bridge and ultrasonically cleans the surface. The oscillated meniscus is in contact therewith. As discussed earlier, the tubular transducer may be momentarily stopped in alignment with selected nozzles to dislodge and remove any viscous plugs 47 of dried ink therein.

The tubular transducer has an internal diameter equal to or slightly larger than the printhead nozzles. The transducer end 45 is planar, as shown in FIG. 4, and parallel to the printhead nozzle face 33. The tubular transducer is excited to a 20 or more Khz excitation by the applied voltage and this excitation is transferred to the cleaning solution within the tubular transducer, and thus to meniscus. This arrangement targets a problem associated with most thermal ink jet printers; namely, the evaporation of the liquid carrier and volatile components of the ink at the ink-air interface which results in the formation of viscous plugs 47 of ink at the printhead nozzles. For triangular nozzles, the evaporation problem tends to collect at the nozzle vertices and this can cause directionality problems for the ejected droplets. The ultrasonic liquid wiper apparatus minimizes the accumulation of viscous ink at the triangular nozzle vertices and expedites removal of any viscous plugs of ink that tend to clog up and prevent droplet ejection. Since the ultrasonic liquid wiper does not physically contact the nozzle face of the printhead, any hydrophobic coating deposited thereon will not be frictionally damaged as in the case of the usual wiper blades.

The tubular transducer may require the deposition of an isolation layer (not shown) of preferred wetting properties with the cleaning solution, and any suitable isolation encapsulate material will suffice, such as the use of parylene conformal coatings. A thin layer of parylene conformal having a thickness of about 25 μm has been found to protect the tubular transducer from the effects of liquid inks, while providing a suitable wetting surface. Other materials, such as, for example, Teflon® are also suitable to coat the tubular transducer 48.

Figure 5:
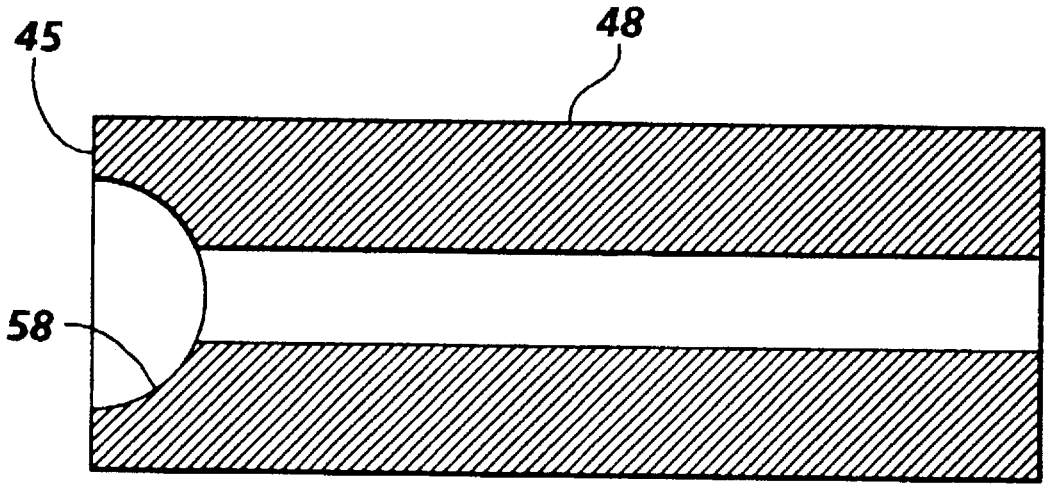
FIG. 5 is an alternate embodiment of the ultrasonic liquid wiper in FIG. 4.
Figure 6:
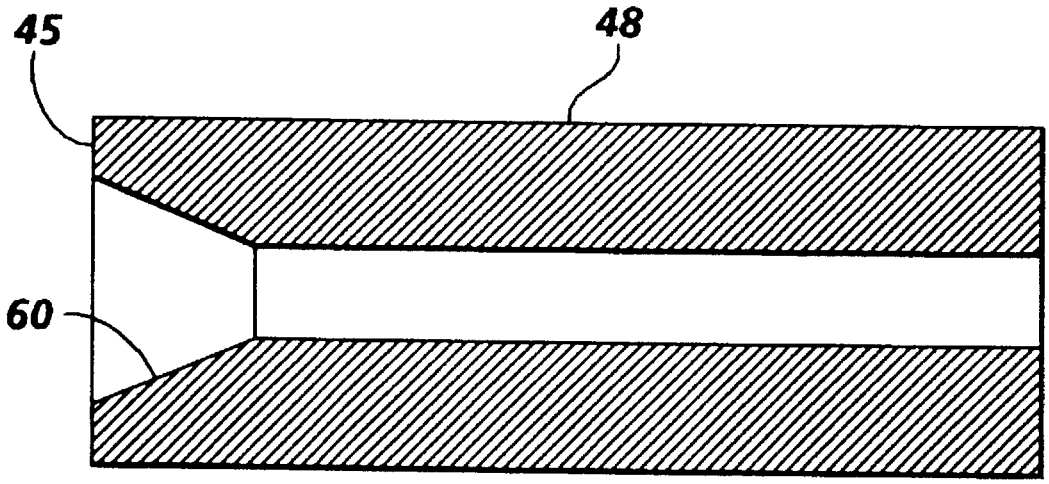
FIG. 6 is another embodiment of the ultrasonic liquid wiper in FIG. 4.

Alternate embodiments of the end 45 of the piezoelectric tubular transducer 48 is shown in FIGS. 5 and 6. In FIG. 5, a spherically shaped concave recess 58 is formed in the transducer end 45, and in FIG. 6, a conically shaped concave recess 60 is formed. These specially shaped transducer ends control the formation and stability of the meniscus shown bridging into contact with a nozzle 15 and viscous plug 47 in FIG. 4. Electrical connection of the leads or electrodes 49 to the tubular transducer may be accomplished by potting the transducer in an epoxy substrate (not shown) for permanent connection or the transducer may be snapped into a female connector (not shown) for subsequent replacement.

In an alternate embodiment (not shown) of the ultrasonic liquid wiper apparatus, the piezoelectric tubular transducer 48 may be replaced by a flexible tube (not shown) having a similar internal diameter as that of tubular transducer 48 with a separate piezoelectric device (not shown) thereagainst to apply the high frequency excitation of the cleaning solution in the flexible tube and thus to the meniscus at the end of the flexible tube confronting the nozzle face of the printhead. The piezoelectric device for this alternate embodiment may be either a disc shape which distorts to apply oscillating pressure to the flexible tube or a rectangular shape which functions in a shear mode to apply oscillating pressure to the flexible tube as disclosed in U.S. Pat. No. 4,584,590 to Fischbeck et al. incorporated herein by reference.

Many modifications and variations are apparent from the foregoing description of the invention, and all such modifications and variations are intended to be within the scope of the present invention.

We claim:

1. In a maintenance station for an ink jet printer having a repositionable printhead with a linear array of nozzles in a nozzle face, the printhead being positionable between a printing location for printing and the maintenance station for servicing and capping, the maintenance station including:

an ultrasonic liquid wiper apparatus comprising a tubular-shaped transducer defining an interior space therein, said space containing a liquid cleaning solution, one end of the transducer having a cleaning nozzle confrontingly spaced from the printhead nozzle face, the cleaning solution being held in the cleaning nozzle by surface tension to form a meniscus;

means for selectively increasing the pressure of the cleaning solution in the cleaning nozzle to cause the meniscus to bulge toward and contact the nozzle face; and means for energizing said transducer so as to ultrasonically excite the cleaning solution and hence the meniscus whereby the portion of the nozzle face contacted by said ultrasonically excited meniscus is cleaned of ink and other contaminants.

2. The maintenance station of claim 1 further including:

at least one vacuum nozzle mounted on the translatable carriage adjacent the cleaning nozzle of the liquid wiper, the vacuum nozzle being confrontingly spaced from the printhead nozzle face for vacuum removal of any cleaning solution deposited on the nozzle face and dissolved or entrained ink therein.

3. The maintenance station of claim 1, wherein the cleaning nozzle has a spherically shaped concave recess.

4. The maintenance station of claim 1, wherein the cleaning nozzle has a conically shaped concave recess.

5. The maintenance station of claim 1, wherein the tubular-shaped piezoelectric transducer has an isolation layer of preferred wetting properties with the cleaning solution.

6. The maintenance station of claim 1, wherein the printer has a printhead mounted on a translatable printhead carriage for printing swaths of information on a stationarily held record medium at a printing zone during each translation of the printhead across the recording medium and, after each swath is printed, the recording medium is stepped the distance of one swath height for printing a subsequent swath of information; and wherein the liquid wiper is fixed in said maintenance station at a location to clean the printhead nozzle face each time the printhead is moved into and out of the maintenance station.

7. The maintenance station of claim 6, wherein the liquid wiper has at least one fixed wiper blade adjacent thereto.

8. The maintenance station of claim 1, wherein the printhead has a full width linear array of nozzles; and wherein the liquid wiper is mounted on a translatable recovery carriage for translation along the full width linear array of printhead nozzles.

9. The maintenance station of claim 4, wherein the maintenance station further comprises:

means for translating the carriage parallel to the printhead nozzle face when the printhead is positioned at the maintenance station;

means for monitoring the location of the carriage relative to each nozzle in the nozzle array;

control means for stopping the carriage, so that the cleaning nozzle is in alignment with selected nozzles of said nozzle array suspected of having viscous plugs of dried ink; and said control means increasing the cleaning solution pressure to cause the meniscus to contact the selected printhead nozzle and form a bridge of cleaning solution between the cleaning nozzle and the printhead nozzle, then said control means energizing the piezoelectric device to ultrasonically excite the cleaning solution and remove the viscous plug in the printhead nozzle.

10. A method for cleaning the nozzle face of an ink jet printhead, comprising the steps of:

positioning a piezoelectric tubular transducer having an open end extending towards said nozzle face and forming a non-contact, predetermined gap with the nozzle face, placing a cleaning solution within said transducer, slightly pressurizing the cleaning solution to create a meniscus at said open end, said meniscus forming a bridge across said gap so as to contact said nozzle face, and energizing said transducer to produce a high frequency oscillation of the meniscus bridge so as to ultrasonically clean the portion of the nozzle face being contacted by said meniscus.

* * * * *